US010839781B2

(12) United States Patent
Ohta et al.

(10) Patent No.: US 10,839,781 B2
(45) Date of Patent: Nov. 17, 2020

(54) ELECTRONIC MUSICAL INSTRUMENT AND ELECTRONIC MUSICAL INSTRUMENT SYSTEM

(71) Applicant: Yamaha Corporation, Hamamatsu (JP)

(72) Inventors: Shinichi Ohta, Hamamatsu (JP); Kenichi Yamauchi, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 16/447,247

(22) Filed: Jun. 20, 2019

(65) Prior Publication Data

US 2019/0304423 A1 Oct. 3, 2019

Related U.S. Application Data

(63) Continuation of application No. PCT/JP2017/046658, filed on Dec. 26, 2017.

(30) Foreign Application Priority Data

Dec. 29, 2016 (JP) ..... 2016-257334

(51) Int. Cl.
*A63H 5/00* (2006.01)
*G10H 1/34* (2006.01)
(Continued)

(52) U.S. Cl.
CPC ..... *G10H 1/34* (2013.01); *G10H 1/00* (2013.01); *G10H 1/02* (2013.01); *G10H 1/46* (2013.01)

(58) Field of Classification Search
CPC .. G10H 1/34; G10H 1/00; G10H 1/02; G10H 1/46
(Continued)

(56) References Cited

U.S. PATENT DOCUMENTS 8,476,517 B2 * 7/2013 Humphrey ..... G09B 15/00 84/470 R
9,415,308 B1 * 8/2016 Zepp ..... H04R 3/00

FOREIGN PATENT DOCUMENTS

JP 2003-348682 A 12/2003
JP 2010-231053 A 10/2010
JP 2011-66604 A 3/2011

OTHER PUBLICATIONS

International Search Report (PCT/ISA/210) issued in PCT Application No. PCT/JP2017/046658 dated Mar. 13, 2018 with English translation (four pages).

(Continued)

*Primary Examiner* — Jianchun Qin
(74) *Attorney, Agent, or Firm* — Crowell & Moring LLP

(57) ABSTRACT

Provided is an electronic musical instrument. The electrical musical instrument is configured to generate an internal acoustic signal; generate a sound generation instruction signal; output the sound generation instruction signal to an external sound source configured to generate an external acoustic signal; switch a first state in which the external acoustic signal is generated by the external sound source in response to the sound generation instruction signal, to a second state in which the internal acoustic signal is generated in response to the sound generation instruction signal; and, when the first state is switched to the second state, control the volume of the internal acoustic signal such that the state relating to the volume of sound generation based on the internal acoustic signal approaches the state relating to the volume of sound generation based on the external acoustic signal.

19 Claims, 10 Drawing Sheets

(51) Int. Cl.
*G10H 1/02* (2006.01)
*G10H 1/46* (2006.01)
*G10H 1/00* (2006.01)

(58) Field of Classification Search
USPC ..... 84/609
See application file for complete search history.

(56) References Cited

OTHER PUBLICATIONS

Japanese-language Written Opinion (PCT/ISA/237) issued in PCT Application No. PCT/JP2017/046658 dated Mar. 13, 2018 (four pages).

* cited by examiner

Example of correspondence table

| Channels | Sound sources | Correction coefficient |
|---|---|---|
| CH1 | External sound source 20a | 1.20 |
| CH2 | (Internal sound source) | — |
| CH3 | External sound source 20b | 1.15 |
| ... | ... | ... |

Fig.3

ELECTRONIC MUSICAL INSTRUMENT AND ELECTRONIC MUSICAL INSTRUMENT SYSTEM

CROSS REFERENCE TO RELATED APPLICATIONS

The present application is a continuation application of International Application No. PCT/JP2017/046658, filed Dec. 26, 2017, which claims a priority to Japanese Patent Application No. 2016-257334, filed Dec. 29, 2016. The contents of these applications are incorporated herein by reference in their entirety.

FIELD OF INVENTION

The present invention relates to an electronic musical instrument that can connect to an external sound source and an electronic musical instrument system including the electronic musical instrument and the external sound source.

BACKGROUND

There are various electronic musical instruments that can connect to an external sound source. For example, in a performance assistance system according to JP 2010-231053A (hereinafter referred to as "Patent Document 1"), an electronic musical instrument is connected to a chord information generation apparatus via a performance assistance apparatus. The electronic musical instrument, the chord information generation apparatus, and the performance assistance apparatus each include a sound source/effect circuit. When the chord information generation apparatus and the performance assistance apparatus are connected through wireless communication, a performance assistance function is enabled, and a local OFF command is automatically transmitted to the electronic musical instrument. In this case, performance information from a performance operator of the electronic musical instrument is not directly supplied to the sound source/effect circuit (musical tone generation unit) of the electronic musical instrument.

Based on a set conversion property, the performance assistance apparatus converts a pitch of note information received from the electronic musical instrument into a pitch that fits the chord information received from the chord information generation apparatus, and the performance assistance apparatus transmits the converted note information to the electronic musical instrument. On the other hand, when the wireless communication between the chord information generation apparatus and the performance assistance apparatus is disconnected or the performance assistance function is turned off, a local ON command is automatically transmitted to the electronic musical instrument. The performance information from the performance operator of the electronic musical instrument is supplied to the sound source/effect circuit (musical tone generation unit) of the electronic musical instrument.

SUMMARY OF INVENTION

In the performance assistance system according to Patent Document 1, the sound source/effect circuit of the chord information generation apparatus or the performance assistance apparatus can also be used as the external sound source of the electronic musical instrument. For example, performance information resulting from operation of a performance operator of the electronic musical instrument can be supplied to the external sound source, and a musical tone obtained based on an acoustic signal obtained from the external sound source can be generated from the electronic musical instrument.

However, if the electronic musical instrument and the external sound source are disconnected, or if a defect occurs in the external sound source, the acoustic signal will no longer be supplied normally from the external sound source to the electronic musical instrument. In this kind of case, it is desirable that sound generation is continued while suppressing a sense of incongruity felt by the user.

An object of the present invention is to provide an electronic musical instrument and an electronic musical instrument system that can continue sound generation while suppressing a sense of incongruity felt by a user when a failure occurs in an acoustic signal supplied from an external sound source.

An electronic musical instrument according to an embodiment of the present invention includes: an internal sound source configured to generate an internal acoustic signal; a generation means for generating a sound generation instruction signal; an output means that is connected to an external sound source configured to generate an external acoustic signal, and is for outputting the sound generation instruction signal to the external sound source; a switching means for switching a first state in which the external acoustic signal is generated by the external sound source in response to the sound generation instruction signal to a second state in which the internal acoustic signal is generated by the internal sound source in response to the sound generation instruction signal; and a volume control means for, when the first state is switched to the second state, controlling a volume of the internal acoustic signal such that a state relating to a volume of sound generation based on the internal acoustic signal approaches a state relating to a volume of sound generation based on the external acoustic signal.

In this electronic musical instrument, if a failure occurs in the external acoustic signal supplied from the external sound source in the first state, a switch is made from the first state to the second state. In the first state, the external acoustic signal is generated by the external sound source in response to a sound generation instruction signal. In the second state, the internal acoustic signal is generated by the internal sound source in response to a sound generation instruction signal. At this time, the volume of the internal acoustic signal is controlled such that the state relating to the volume of sound generation based on the internal acoustic signal approaches the state relating to the volume of sound generation based on the external acoustic signal. Accordingly, even if a failure occurs in the external acoustic signal, sound generation can be continued while suppressing a sense of incongruity felt by the user.

The electronic musical instrument may further include: a first setting means for setting a first value as a value of a parameter relating to the volume of the internal acoustic signal; a second setting means for setting a second value as a value of a parameter relating to the volume of the external acoustic signal; and a first acquisition means for acquiring the second value set by the second setting means, wherein when the first state is switched to the second state, the volume control means controls the first value based on the acquired second value such that the state relating to the volume of sound generation based on the internal acoustic signal approaches the state relating to the volume of sound generation based on the external acoustic signal.

The volume control means may include a correction means for, when the first state is switched to the second state, correcting the set first value based on the acquired second value such that the state relating to the volume of sound generation based on the internal acoustic signal approaches the state relating to the volume of sound generation based on the external acoustic signal.

In this case, the first value relating to the volume of the internal acoustic signal is corrected based on the second value relating to the volume of the external acoustic signal. Accordingly, the state relating to the volume of sound generation based on the internal acoustic signal approaches the state relating to the volume of sound generation based on the external acoustic signal. Accordingly, even if a failure occurs in the external acoustic signal, sound generation can be continued while suppressing a sense of incongruity felt by the user.

The electronic musical instrument may further include a second acquisition means for acquiring a correspondence relationship between the first value and the second value in a case where the state relating to the volume is equal for sound generation based on the internal acoustic signal and sound generation based on the external acoustic signal, wherein when the first state is switched to the second state, the volume control means controls the first value based on the acquired correspondence relationship and the acquired second value.

In this case, when the first state is switched to the second state, the first value can easily be controlled based on the correspondence relationship. Also, since the state relating to the volume is equal in sound generation based on the internal acoustic signal and sound generation based on the external acoustic signal, sound generation can be continued while suppressing a sense of incongruity felt by the user.

The correspondence relationship may be determined for each timbre, and when the first state is switched to the second state, the volume control means may adjust the first value based on a correspondence relationship corresponding to a timbre of the external acoustic signal among the acquired correspondence relationships, and based on the acquired second value. Accordingly, the first value can be suitably controlled based on the correspondence relationship for each timbre.

The first value may indicate the volume or pan position of the internal acoustic signal, and the second value may indicate the volume or pan position of the external acoustic signal. Accordingly, it is possible to ensure continuity of the volume or pan position of a generated sound.

The electronic musical instrument may include a plurality of channels, the first setting means may set the first value for each of the plurality of channels, the second setting means may set the second value for each of the plurality of channels, and when the first state is switched to the second state for one or more target channels among the plurality of channels, the volume control means may control the first value corresponding to the target channel based on the acquired correspondence relationship and the acquired second value corresponding to the target channel. In this case, in each channel, sound generation can be continued while suppressing a sense of incongruity felt by the user.

The electronic musical instrument may further include a mixer configured to mix the internal acoustic signal corresponding to a first channel among the plurality of channels and the external acoustic signal corresponding to a second channel among the plurality of channels, wherein in the first state, the external acoustic signal corresponding to the second channel is generated by the external sound source in response to the sound generation instruction signal corresponding to the second channel, in the second state, the internal acoustic signal corresponding to the second channel is generated by the internal sound source in response to the sound generation instruction signal corresponding to the second channel, the first setting means sets the first value of the internal acoustic signal corresponding to the second channel, the second setting means sets the second value of the external acoustic signal corresponding to the second channel, the first acquisition means acquires the second value corresponding to the second channel set by the second setting means, and when the first state is switched to the second state for the second channel, the volume control means controls the first value corresponding to the second channel based on the acquired second value corresponding to the second channel. In this case, when the state of the electronic musical instrument is switched from the first state to the second state, it is possible to continue sound generation while suppressing a sense of incongruity felt by the user.

The electronic musical instrument may further include a first mixer configured to mix the internal acoustic signals corresponding to two or more channels among the plurality of channels, wherein the electronic musical instrument can connect to a second mixer configured to mix the external acoustic signals corresponding to two or more channels among the plurality of channels, in the first state, the external acoustic signal corresponding to a first channel is generated by the external sound source in response to the sound generation instruction signal corresponding to the first channel among the plurality of channels, in the second state, the internal acoustic signal corresponding to the first channel is generated by the internal sound source in response to the sound generation instruction signal corresponding to the first channel, the first setting means sets the first value of the internal acoustic signal corresponding to the first channel, the second setting means sets the second value of the external acoustic signal corresponding to the first channel, the first acquisition means acquires the second value corresponding to the first channel set by the second setting means, and when the first state is switched to the second state for the first channel, the volume control means controls the first value corresponding to the first channel based on the acquired second value corresponding to the first channel. In this case, when the state of the electronic musical instrument is switched from the first state to the second state, it is possible to continue sound generation performed by the first and second mixers while suppressing a sense of incongruity felt by the user.

The electronic musical instrument may further include a third setting means for setting a plurality of regions determined based on a third value included in the sound generation instruction signal, wherein the external sound source is allocated to a first region among the set plurality of regions, the first setting means sets the first value of the internal acoustic signal for the first region, the second setting means sets the second value of the external acoustic signal for the first region, the first acquisition means acquires the second value set for the first region, and when the first state is switched to the second state for the first region, the volume control means controls the first value for the first region based on the second value acquired for the first region.

In this case, even if a failure occurs in the external acoustic signal generated from the external sound source allocated to the first region, the first state is switched to the second state for the first region. Also, the first value set for the first region is controlled. Accordingly, it is possible to continue sound generation while suppressing a sense of incongruity felt by the user, based on the internal acoustic signal generated from the internal sound source.

The electronic musical instrument may further include: an input means for receiving the external acoustic signal generated by the external sound source as a feedback acoustic signal; and a detection means for detecting a state of input of the feedback acoustic signal to the input means, wherein the switching means switches the first state to the second state in response to a transition from a state in which input of the feedback acoustic signal to the input means is normal, to a state in which input of the feedback acoustic signal to the input means is not normal. According to this configuration, when a failure occurs in the external acoustic signal supplied from the external sound source, the first state can be reliably switched to the second state.

The switching means may switch the second state to the first state in response to a transition from a state in which input of the feedback acoustic signal to the input means is not normal, to a state in which input of the feedback acoustic signal to the input means is normal. According to this configuration, when a failure in the external acoustic signal supplied from the external sound source is resolved, the second state can be reliably switched to the first state.

An electronic musical instrument system according to an embodiment of the present invention includes: the above-described electronic musical instrument; one or more external sound sources connected to the electronic musical instrument; and a sound generation means configured to generate a sound based on the internal acoustic signal generated by the internal sound source of the electronic musical instrument and the external acoustic signal generated by the one or more external sound sources.

In this electronic musical instrument system, when a failure occurs in the external acoustic signal supplied from the external sound source in the first state, the first state is switched to the second state. In the first state, the external acoustic signal is generated by the external sound source in response to the sound generation instruction signal from the electronic musical instrument. In the second state, the internal acoustic signal is generated by the internal sound source of the electronic musical instrument in response to the sound generation instruction signal. At this time, the volume of the internal acoustic signal is controlled such that the state relating to the volume of sound generation based on the internal acoustic signal approaches the state relating to the volume of sound generation based on the external acoustic signal. Accordingly, even if a failure occurs in the external acoustic signal, sound generation can be continued while suppressing a sense of incongruity felt by the user.

A method according to an embodiment of the present invention includes the following:

(1) Generating a sound generation instruction signal in an electronic musical instrument including an internal sound source for generating an internal acoustic signal;

(2) Outputting the sound generation instruction signal from the electronic musical instrument to an external sound source for generating an external acoustic signal;

(3) Switching a first state in which the external acoustic signal is generated by the external sound source in response to the sound generation instruction signal, to a second state in which the internal acoustic signal is generated by the internal sound source in response to the sound generation instruction signal; and (4) Automatically controlling a volume of the internal acoustic signal when the first state is switched to the second state, such that a state relating to a volume of sound generation based on the internal acoustic signal approaches a state relating to a volume of sound generation based on the external acoustic signal.

A program according to an embodiment of the present invention causes a computer to execute the following:

(1) Generating a sound generation instruction signal in an electronic musical instrument including an internal sound source for generating an internal acoustic signal;

(2) Outputting the sound generation instruction signal from the electronic musical instrument to an external sound source for generating an external acoustic signal;

(3) Switching a first state in which the external acoustic signal is generated by the external sound source in response to the sound generation instruction signal, to a second state in which the internal acoustic signal is generated by the internal sound source in response to the sound generation instruction signal; and (4) Controlling a volume of the internal acoustic signal when the first state is switched to the second state, such that a state relating to a volume of sound generation based on the internal acoustic signal approaches a state relating to a volume of sound generation based on the external acoustic signal.

According to an embodiment of the present invention, it is possible to continue sound generation while suppressing a sense of incongruity felt by a user when a failure occurs in an acoustic signal supplied from an external sound source.

BRIEF DESCRIPTION OF DRAWINGS

FIG. 3 is a diagram showing an example of a correspondence table stored in a storage device shown in FIG. 1.

DETAILED DESCRIPTION OF THE PREFERRED EMBODIMENTS

Hereinafter, an electronic musical instrument and an electronic musical instrument system according to an embodiment of the present invention will be described in detail with reference to the drawings.

First Embodiment (1) Configuration of Electronic Musical Instrument System

Figure 1:
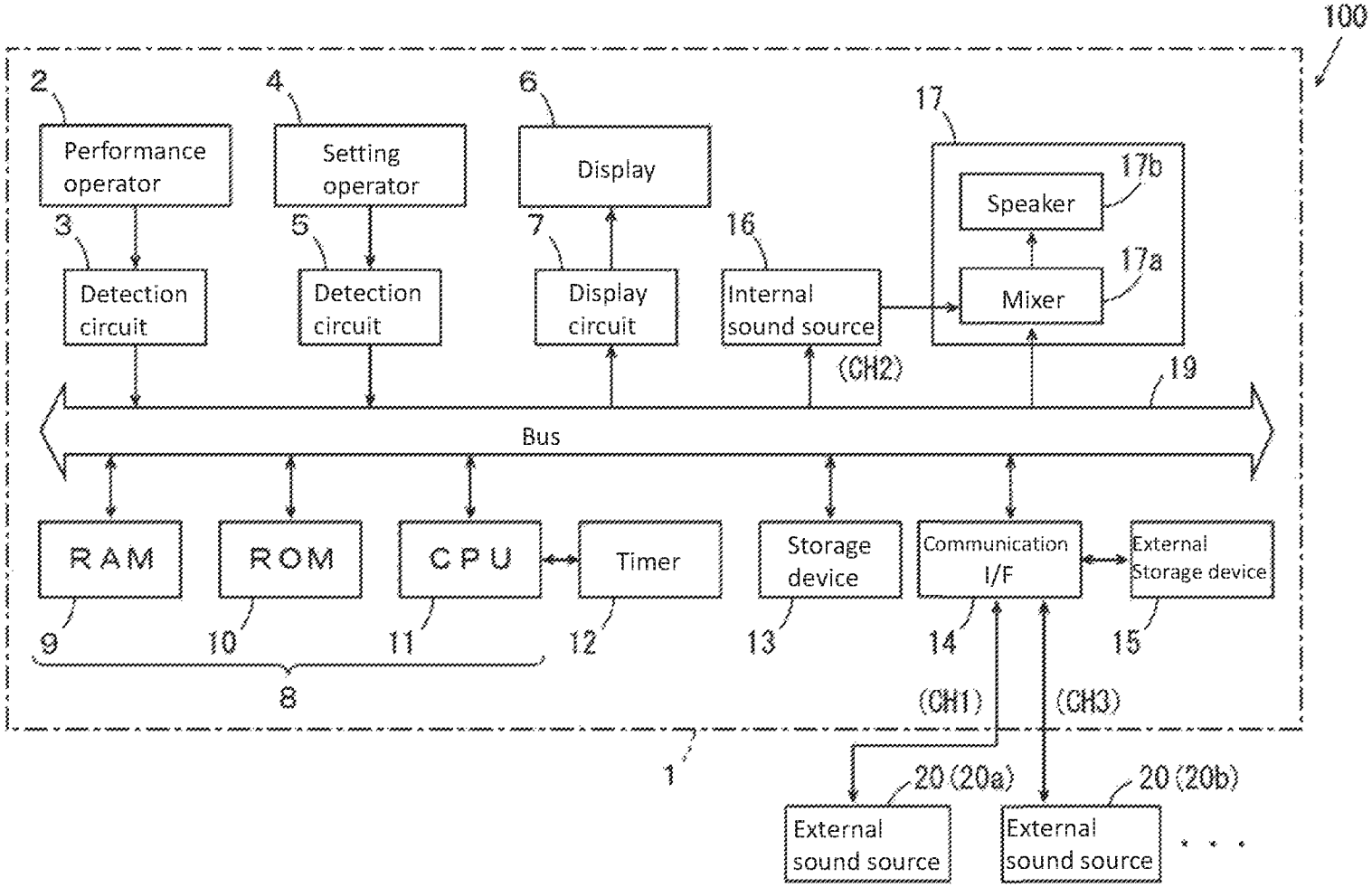
FIG. 1 is a block diagram showing a configuration of an electronic musical instrument system according to a first embodiment.

FIG. 1 is a block diagram showing a configuration of an electronic musical instrument system according to a first embodiment. An electronic musical instrument system 100 shown in FIG. 1 is constituted by an electronic musical instrument 1 and one or more external sound sources 20. In the present embodiment, multiple external sound sources 20*a* and 20*b* are connected to the electronic musical instrument 1. Hereinafter, if each of the multiple external sound sources 20 is to be distinguished, the external sound sources 20 will be called "external sound source 20*a*" or "external sound source 20*b*".

The electronic musical instrument 1 includes a performance operator 2, a detection circuit 3, a setting operator 4, a detection circuit 5, a display 6, and a display circuit 7. The performance operator 2 includes a keyboard, and a drum pad. The performance operation 2 is connected to a bus 19 via the detection circuit 3 and performance data obtained based on a performance operation performed by the user is input through the performance operator 2. The setting operator 4 includes a switch that is operated to be turned on or off, a rotary encoder that is operated by rotation, a linear encoder that is operated by sliding, or the like, and the setting operator 4 is connected to the bus 19 via the detection circuit 5. The setting operator 4 is used to perform switching of the timbre, adjustment of the volume, turning on and off of the power, and various types of settings.

The display 6 is connected to the bus 19 via the display circuit 7. A musical piece name, channel number, timbre name, volume, parameter value, musical notation, or various other types of information are displayed on the display 6. The display 6 may also be a touch panel display. In this case, the user can instruct various operations by operating the display 6.

The electronic musical instrument 1 further includes a RAM (random access memory) 9, a ROM (read only memory) 10, a CPU (central processing unit) 11, a timer 12, a storage device 13, and a communication I/F (interface) 14. The RAM 9, the ROM 10, the CPU 11, the storage device 13, and the communication I/F 14 are connected to the bus 19, and the timer 12 is connected to the CPU 11. An external device such as an external storage device 15 may also be connected to the bus 19 via the communication I/F 14. The RAM 9, the ROM 10, and the CPU 11 form a sound source control unit 8.

The RAM 9 is composed of a volatile memory, for example, and is used as a work area for the CPU 11 and temporarily stores various types of data. The ROM 10 is composed of a non-volatile memory, for example, and stores computer programs such as a system program and a sound source control program. The CPU 11 performs later-described sound source control processing by executing a sound source control program stored in the ROM 10 on the RAM 9. The timer 12 gives time information such as the current time to the CPU 11.

The storage device 13 includes a storage medium such as a hard disk, an optical disk, a magnetic disk, or a memory card. The storage device 13 stores one or more pieces of musical piece data. Musical piece data is an acoustic signal (audio signal) expressing a musical piece. Here, the acoustic signal is composed of multiple sampling values obtained by sampling a waveform signal indicating a change in sound, at a predetermined sampling period. The musical piece data may be generated based on the performance data input from the performance operator 2 and stored in the storage device 13. The performance data and the musical piece data include later-described sound generation instruction signals. The above-described sound generation control program may also be stored in the storage device 13. Similarly to the storage device 13, the external storage device 15 may also include a storage medium such as a hard disk, an optical disk, a magnetic disk, or a memory card, and may store various types of data such as musical piece data, or a sound source control program.

Note that the sound source control program in the present embodiment may also be provided in a mode of being stored in a computer-readable storage medium, and may be installed in the ROM 10 or the storage device 13. Also, if the communication I/F 14 is connected to a communication network, a sound source control program distributed from a server connected to the communication network may also be installed in the ROM 10 or the storage device 13.

The electronic musical instrument 1 further includes an internal sound source 16 and a sound system 17. The internal sound source 16 is connected to the bus 19, and the sound system 17 is connected to the internal sound source 16 and the bus 19. The internal sound source 16 generates an acoustic signal based on the performance data input from the performance operator 2, the musical piece data obtained from the storage device 13, or the like, and adds an acoustic effect to the acoustic signal.

Each external sound source 20 is connected to the communication I/F 14, generates an acoustic signal based on the performance data input from the performance operator 2, the musical piece data obtained from the storage device 13, or the like, and adds an acoustic effect to the acoustic signal. Also, each external sound source 20 outputs the generated acoustic signal to the communication I/F 14. The sound system 17 includes a mixer 17*a* and a speaker 17*b*, and further includes a D/A (digital/analog) conversion circuit and amplifier (not shown). The sound system 17 generates a musical tone obtained based on the acoustic signal provided from the internal sound source 16 or the external sound source 20.

In the present embodiment, the communication I/F 14 includes a MIDI (Musical Instrument Digital Interface) input terminal, a MIDI output terminal, an audio input terminal, and an audio output terminal. The communication I/F 14 and the external sound sources 20 are connected using a MIDI cable and an audio cable, and perform communication based on the MIDI standard. Also, in the present embodiment, the electronic musical instrument 1 has multiple MIDI channels (hereinafter referred to simply as "channels"). In the present embodiment, different channels CH1 and CH3 are allocated to the multiple external sound sources 20*a* and 20*b* respectively, and a channel CH2 is allocated to the internal sound source 16. Also, the mixer 17*a* of the sound system 17 has channels ch1, ch2, and ch3. The acoustic signals of the channels CH1, CH2, and CH3 are input to the channels ch1, ch2, and ch3 of the mixer 17*a*. The gains of the channels ch1, ch2, and ch3 of the mixer 17*a* can be adjusted. The volumes of the acoustic signals input to the channels ch1, ch2, and ch3 can be adjusted by adjusting the gains of the channels ch1, ch2, and ch3. The mixer 17*a* mixes the acoustic signals input to the channels ch1, ch2, and ch3 and outputs the mixed acoustic signal to the speaker 17*b*. Accordingly, a musical tone obtained based on the multiple acoustic signals generated by the external sound source 20*a*, the internal sound source 16, and the external sound source 20*b* is generated by the speaker 17*b*.

(2) Operation of Sound Source Control Unit

The user of the electronic musical instrument 1 shown in FIG. 1 can set a desired timbre selected from multiple timbres for the internal sound source 16 and the external sound sources 20 by operating the setting operator 4. The internal sound source 16 generates an acoustic signal with the set timbre when the sound generation instruction signal is provided. The external sound sources 20 generate acoustic signals with the set timbre when the sound generation instruction signal is provided. Accordingly, the user can play the electronic musical instrument 1 while causing musical tones with various timbres to be reproduced from the sound system 17. Hereinafter, the acoustic signal generated by the internal sound source 16 will be referred to as an "internal acoustic signal" and the acoustic signals generated by the external sound sources 20 will be referred to as "external acoustic signals".

For the channels allocated to the external sound sources 20, when a connection failure between the external sound sources 20 and the communication I/F 14, disconnection of communication between the external sound sources 20 and the communication I/F 14, a failure of the external sound sources 20, or the like occurs, a failure of the external acoustic signals occurs in some cases. A failure of an external acoustic signal means a state in which an external acoustic signal is not provided from an external sound source 20 to the electronic musical instrument 1, a state in which the external acoustic signal provided from the external sound source 20 to the electronic musical instrument 1 is cut off, a state in which the external acoustic signal provided from the external sound source 20 to the electronic musical instrument 1 is unstable, or the like. When such a failure of an external acoustic signal occurs (if the state of input of an external acoustic signal is not normal), the desired musical tone cannot be generated from the sound system 17.

In view of this, when a failure of an external acoustic signal occurs in a channel allocated to an external sound source 20, the sound source control unit 8 switches the external acoustic signals to the internal acoustic signal of the internal sound source 16. In this case, the sound source control unit 8 sets the gain of the mixer 17*a* such that the volume of the musical tone generated based on the internal acoustic signal approaches the volume of the musical tone generated based on the external acoustic signal. In the present embodiment, the gain of the mixer 17*a* is set such that the volume of the musical tone generated based on the internal acoustic signal becomes equal to the volume of the musical tone generated based on the external acoustic signal.

Also, in the present embodiment, a correspondence table is stored in the storage device 13 for each channel in order to make the volume of the musical tone generated based on the internal acoustic signal and the volume of the musical tone generated based on the external acoustic signal equal before and after a failure in the external acoustic signal. The correspondence table is a table indicating the correspondence relationship between the gain of the mixer 17*a* that is to be set when performing input of the internal acoustic signal, and the gain of the mixer 17*a* that is to be set when performing input of the external acoustic signal. In this case, when a failure of the external acoustic signal occurs, the sound source control unit 8 corrects the gain set in the mixer 17*a* before the failure occurred, based on the correspondence table stored in the storage device 13.

Also, the sound source control unit 8 sets the timbre of the internal acoustic signal of the internal sound source 16 such that the internal acoustic signal is generated with the timbre associated in advance with the timbre of the external acoustic signal (e.g., a timbre having a predetermined degree of similarity, that is, a similar timbre). Furthermore, the sound source control unit 8 provides the internal sound source 16 with the sound generation signals that are to be provided to the external sound sources 20. Accordingly, the internal acoustic signal with the timbre associated in advance with the timbre of the external acoustic signal is generated by the internal sound source 16. Accordingly, the user can continue playing the electronic musical instrument 1 while causing generation of a musical tone with a desired timbre from the sound system 17, even when a failure of the external acoustic signal occurs. Note that the timbre associated in advance with the timbre of the external acoustic signal also includes a timbre that is identical to the timbre of the external acoustic signal.

The sound source control unit 8 is not limited to the case in which a failure of the external acoustic signal occurs, and the external acoustic signal may also be switched to the internal acoustic signal of the internal sound source 16 based on an operation of the setting operator 4 performed by the user.

(3) Functional Configuration of Sound Source Control Unit

Figure 2:
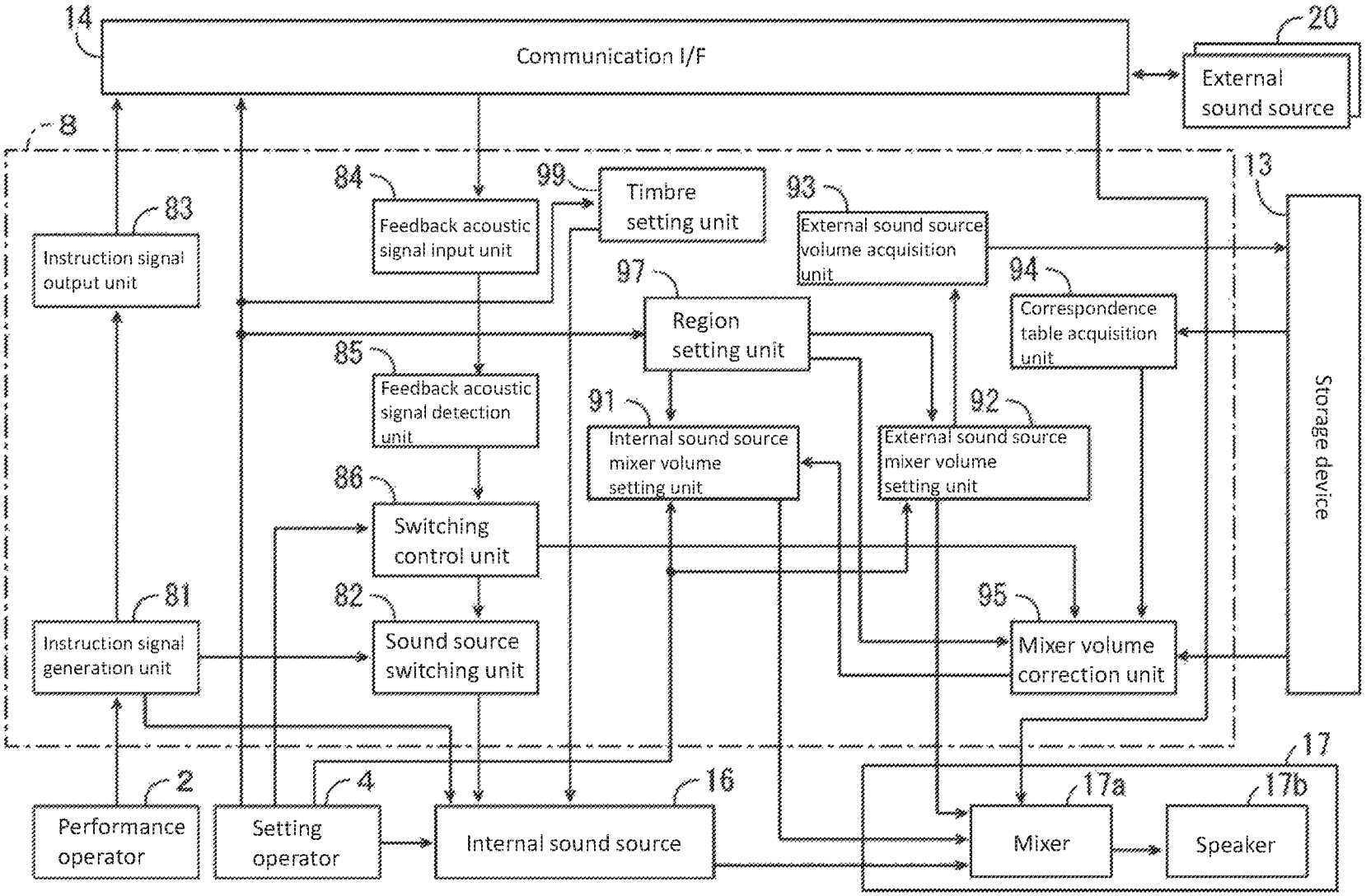
FIG. 2 is a block diagram showing a functional configuration of a sound source control unit shown in FIG. 1.

FIG. 2 is a block diagram showing a functional configuration of the sound source control unit 8 shown in FIG. 1. As shown in FIG. 2, the sound source control unit 8 includes an instruction signal generation unit 81, a sound source switching unit 82, an instruction signal output unit 83, a feedback acoustic signal input unit 84, a feedback acoustic signal detection unit 85, and a switching control unit 86. Also, the sound source control unit 8 further includes an internal sound source mixer volume setting unit 91, an external sound source mixer volume setting unit 92, an external sound source volume acquisition unit 93, a correspondence table acquisition unit 94, a mixer volume correction unit 95, a region setting unit 97, and a timbre setting unit 99. The functions of the units of the sound source control unit 8 shown in FIG. 2 are realized by the CPU 11 shown in FIG. 1 executing a sound source control program stored in the ROM 10 or the storage device 13.

The instruction signal generation unit 81 generates various instruction signals such as a sound generation instruction signal for each channel, based on an operation of the performance operator 2 or musical piece data. Among the sound generation instruction signals generated by the instruction signal generation unit 81, the sound generation instruction signal to be provided to the internal sound source 16 is provided to the internal sound source 16. Among the sound generation instruction signals generated by the instruction signal generation unit 81, the sound generation instruction signals to be provided to the external sound sources 20 are provided to the sound source switching unit 82 and the instruction signal output unit 83. In the present embodiment, the sound generation instruction signal of the channel CH2 is provided to the internal sound source 16, and the sound generation instruction signals of the channels CH1 and CH3 are provided to the external sound sources 20. Supply of the sound generation instruction signal to the internal sound source 16 or the external sound sources 20 is switched using a local OFF command and a local ON command based on the MIDI standard, for example. The sound source switching unit 82 can, for each channel, switch between a connected state in which the acquired sound generation instruction signal is provided to the internal sound source 16, and a non-connected state in which the acquired sound generation instruction signal is not provided to the internal sound source 16.

The instruction signal output unit 83 is connected to the communication I/F 14 and outputs the sound generation instruction signals generated by the instruction signal generation unit 81 to the external sound sources 20. The external sound sources 20 generate the external acoustic signals in response to the sound generation instruction signal and input the generated external acoustic signals to the communication I/F 14. The feedback acoustic signal input unit 84 acquires the external acoustic signals from the communication I/F 14 as feedback acoustic signals (audio return). The feedback acoustic signal detection unit 85 detects the state of input of the feedback acoustic signals to the feedback acoustic signal input unit 84.

The switching control unit 86 sets the sound source switching unit 82 to the non-connected state if the state of input of the feedback acoustic signals detected by the feedback acoustic signal detection unit 85 is normal. Accordingly, musical tones obtained based on the external acoustic signals are generated from the sound system 17. On the other hand, the switching control unit 86 switches the sound source switching unit 82 to the connected state if the state of input of the feedback acoustic signals detected by the feedback acoustic signal detection unit 85 is not normal. Accordingly, a musical tone obtained based on the internal acoustic signal is generated from the sound system 17.

It is also possible to switch the sound source switching unit 82 to the connected state or the non-connected state based on an operation of the performance operator 4 performed by the user. For this reason, if the user notices a failure in the external acoustic signals, the user can switch the sound source switching unit 82 from the non-connected state to the connected state. Also, if the user notices that the failure of the external acoustic signals has been resolved, the user can switch the sound source switching unit 82 from the connected state to the non-connected state.

The timbre setting unit 99 sets the timbre of the internal sound source 16 so as to generate an internal acoustic signal with a timbre associated in advance with the timbre of the external acoustic signal for when the sound source switching unit 82 is in the non-connected state (when a musical tone obtained based on the external acoustic signal is being generated by the sound system 17).

The instruction signal generation unit 81 may also generate the volume setting instruction signal based on an operation of the setting operator 4, or may generate the volume setting instruction signal based on the musical tone data. The volume setting instruction signal is, for example, a control change message based on the MIDI standard.

If the volume setting instruction signal is provided through an operation of the setting operator 4 for the channel allocated to the internal sound source 16, the internal sound source mixer volume setting unit 91 sets the gain corresponding to the volume indicated by the volume setting instruction signal in the corresponding channel of the mixer 17*a*. Also, if the volume setting instruction signal is provided through an operation of the setting operator 4 in the channels allocated to the external sound sources 20, the external sound source mixer volume setting unit 92 sets the gain corresponding to the volume indicated by the volume setting instruction signal in the corresponding channel of the mixer 17*a*.

At the time at which the external sound source mixer volume setting unit 92 sets the gain in the mixer 17*a*, the external sound source volume acquisition unit 93 acquires the gain (volume) set in the mixer 17*a* along with the channel number, and stores the acquired gain and the channel number in the storage device 13.

The correspondence table acquisition unit 94 acquires the correspondence table stored in the storage device 13 at a predetermined timing. For example, the predetermined timing is set to the timing of switching the sound source switching unit 82 from the non-connected state to the connected state. In response to the switching of the sound source switching unit 82 from the non-connected state to the connected state, the mixer volume correction unit 95 corrects the gain set in the mixer 17*a* using the correspondence table, such that the volume of the musical tone generated based on the internal acoustic signal and the volume of the musical tone generated based on the external acoustic signal become equal. Accordingly, sound generation can be continued while suppressing a sense of incongruity felt by the user.

Also, in response to the switching of the sound source switching unit 82 from the connected state to the non-connected state, the mixer volume correction unit 95 corrects the gain set in the mixer 17*a* with a procedure that is the inverse of the example described above, such that the volume of the musical tone generated based on the external acoustic signal becomes equal to the volume of the musical tone generated based on the internal acoustic signal.

The region setting unit 97 sets multiple later-described regions (zones) defined based on values of a parameter included in the sound generation instruction signal. In this case, the internal sound source mixer volume setting unit 91 and the external sound source mixer volume setting unit 92 can perform setting of the gain in the mixer 17*a* for each region. Also, the mixer volume correction unit 95 can perform correction of the gain for each region.

(4) Example of Correction of Gains Set in Mixer

FIG. 3 is a diagram showing an example of a correspondence table stored in the storage device 13 of FIG. 1. In the correspondence table shown in FIG. 3, the ratios between the gain to be set in the mixer 17*a* when inputting the internal acoustic signal and the gains to be set in the mixer 17*a* when inputting the external acoustic signals are set as correction coefficients, in order to make the volume of the musical tone generated based on the internal acoustic signal and the volume of the musical tones generated based on the external acoustic signals equal. In the example shown in FIG. 3, 1.20 is set as the correction coefficient for the channel CH1 allocated to the external sound source 20*a*, and 1.15 is set as the correction coefficient for the channel CH3 allocated to the external sound source 20*b*. Note that the acoustic signal input to the mixer 17*a* does not change due to the switching of the sound source switching unit 82, and therefore the above-described ratio is not set for the channel CH2 allocated to the internal sound source 16.

Figure 4B:
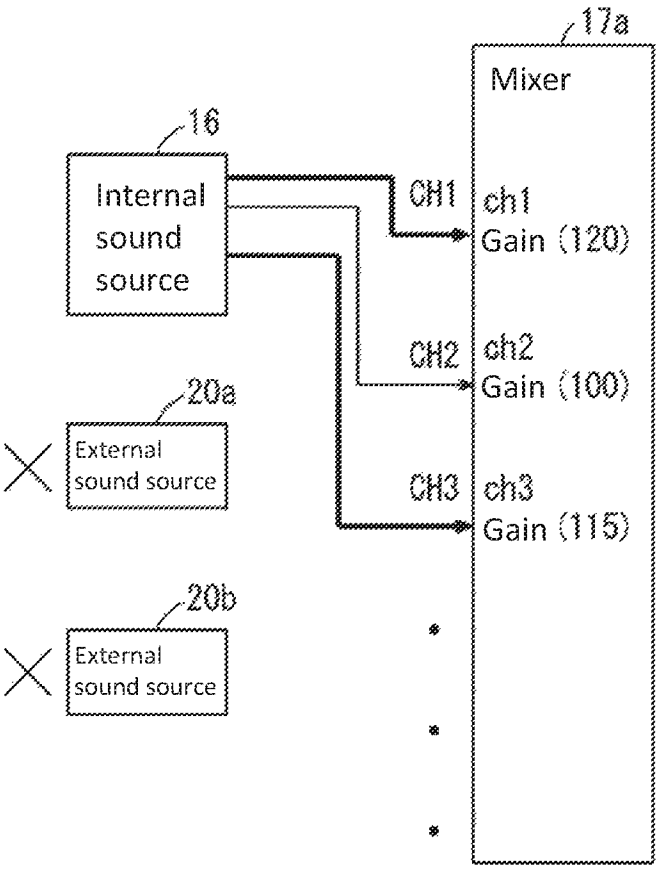
FIGS. 4A and 4B are schematic diagrams showing an example of gain correction based on the correspondence table shown in FIG. 3.
Figure 4A:
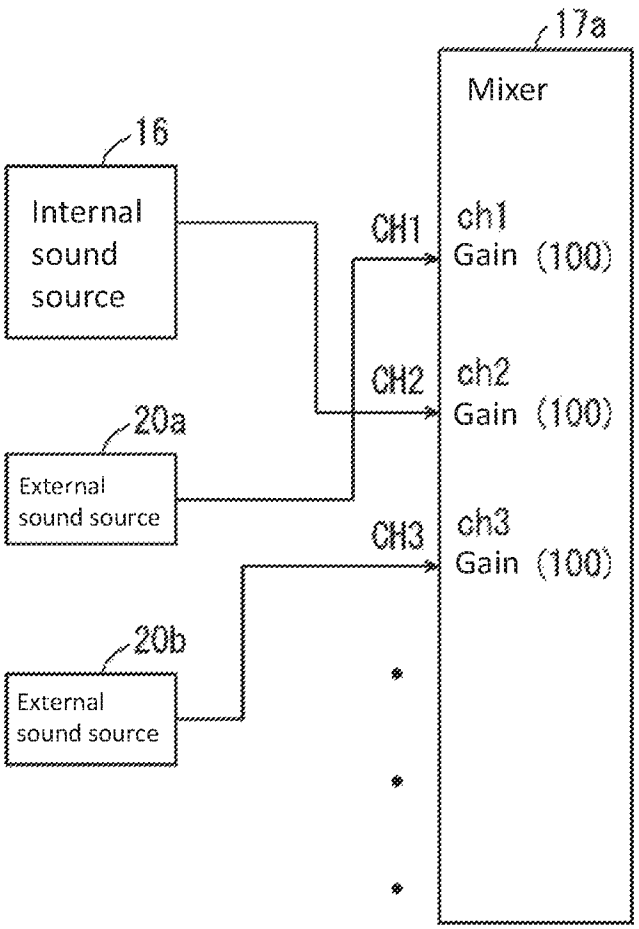

FIGS. 4A and 4B are schematic diagrams showing an example of gain correction based on the correspondence table shown in FIG. 3. FIG. 4A shows an example of gains set in the mixer 17*a* when the sound source switching unit 82 shown in FIG. 2 is in the non-connected state. FIG. 4B shows an example of gains set in the mixer 17*a* when the sound source switching unit 82 shown in FIG. 2 is in the connected state.

As shown in FIG. 4A, if the sound source switching unit 82 is in the non-connected state, a gain of 100 is set for each of the channels ch1, ch2, and ch3 of the mixer 17*a*. In this state, if a failure occurs in the external acoustic signals generated by the external sound sources 20*a* and 20*b*, the sound source switching unit 82 is switched from the non-connected state to the connected state. In this case, as indicated by the thick solid lines in FIG. 4B, the internal acoustic signals of the channels CH1 and CH3 generated by the internal sound source 16 are input to the channels ch1 and ch3 of the mixer 17*a*.

At this time, based on the correspondence table shown in FIG. 3, the mixer volume correction unit 95 shown in FIG.

2 corrects the gains 100 set for the channels ch1 and ch3 of the mixer 17*a* when the sound source switching unit 82 is in the non-connected state. In this case, the mixer volume correction unit 95 multiplies the correction coefficients 1.20 and 1.15 in the correspondence table by the respective gains of the channels ch1 and ch3 of the mixer 17*a*, thereby calculates the gains 120 and 115, and sets the calculated gains 120 and 115 for the channels ch1 and ch3 of the mixer 17*a*. Accordingly, it is possible to continue sound generation while suppressing a sense of incongruity felt by the user when the sound source switching unit 82 is switched from the non-connected state to the connected state.

(5) Sound Source Control Processing

Figure 5:
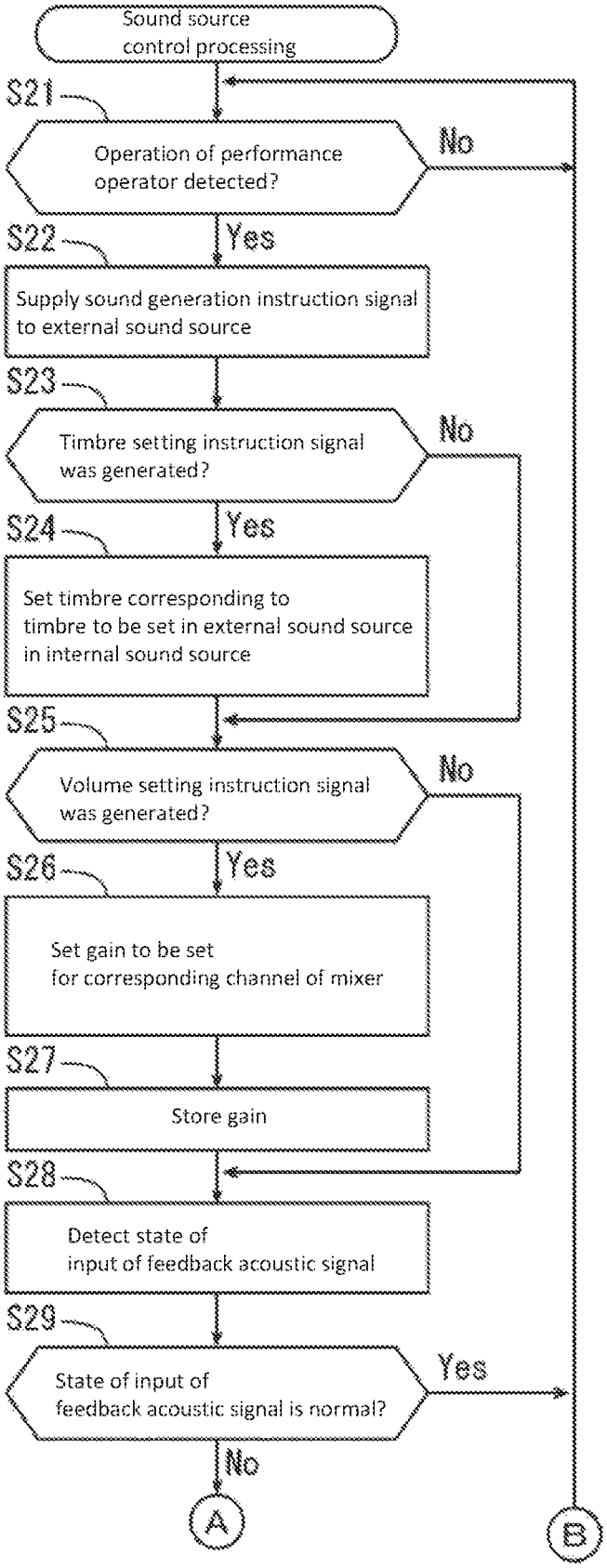
FIG. 5 is a flowchart showing sound source control processing performed by a sound source control unit.
Figure 6:
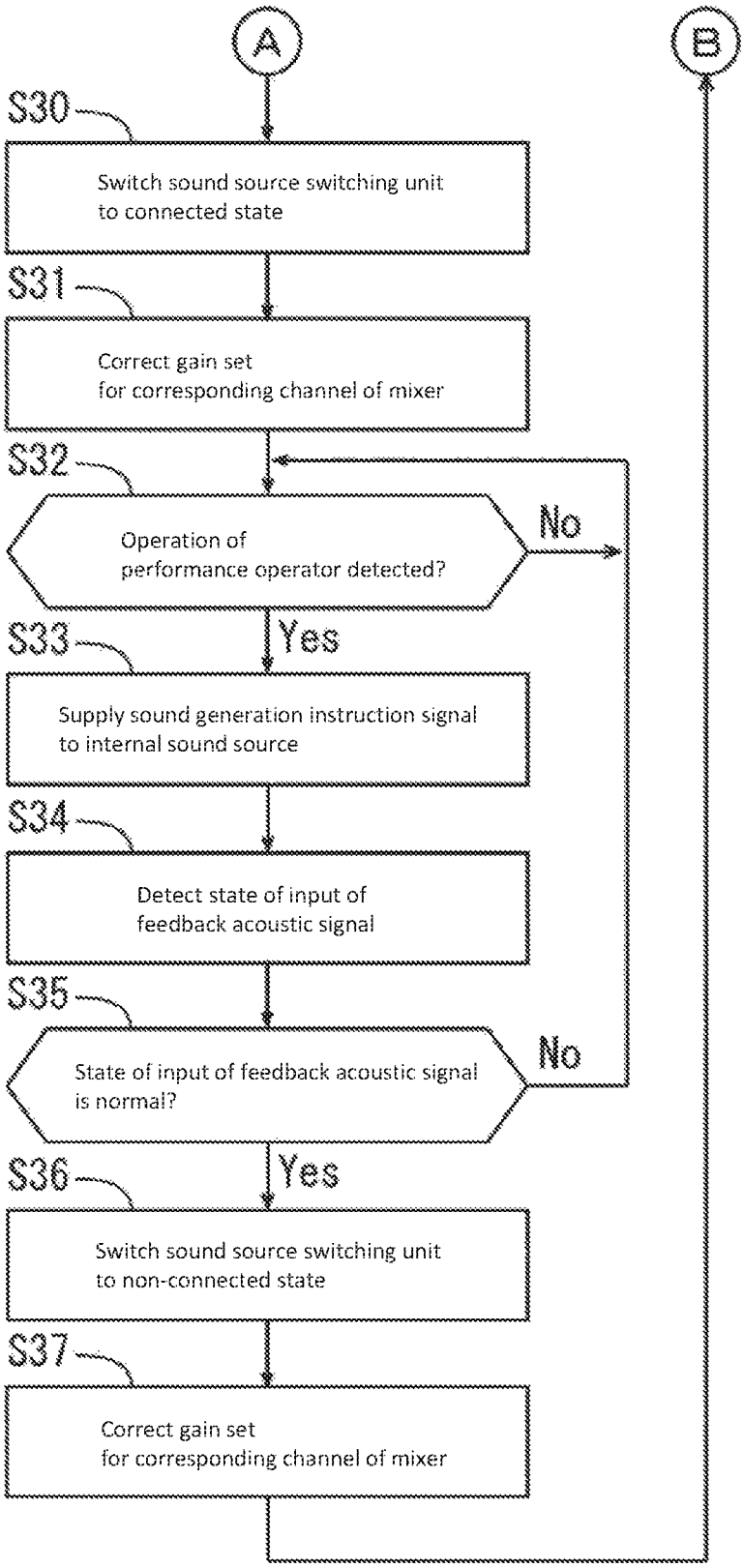
FIG. 6 is a flowchart showing sound source control processing performed by the sound source control unit.

FIGS. 5 and 6 are flowcharts showing sound source control processing performed by the sound source control unit 8. The sound source control processing shown in FIGS. 5 and 6 is performed by the CPU 11 shown in FIG. 1 executing a sound source control program stored in the ROM 10 or the storage device 13. The following sound source control processing is performed on each channel allocated to the external sound sources 20. In the initial state, the sound source switching unit 82 shown in FIG. 2 is in a non-connected state.

First, the instruction signal generation unit 81 determines whether or not an operation of the performance operator 2 has been detected (step S21). If no operation of the performance operator 2 has been detected, the instruction signal generation unit 81 waits until an operation of the performance operator 2 is detected. If an operation of the performance operator 2 has been detected, the instruction signal generation unit 81 generates the sound generation instruction signal and supplies the sound generation instruction signal to the external sound source 20 via the instruction signal output unit 83 and the communication I/F 14 (step S22). The external sound source 20 generates an external acoustic signal with a set timbre when the sound generation instruction signal is provided. The generated external acoustic signal is supplied to the mixer 17*a* through the communication I/F 14.

Next, the timber setting unit 99 determines whether or not a timbre setting instruction signal has been generated based on an operation of the setting operator 4 (step S23). The timbre setting instruction signals include information indicating the timbre to be set in the external sound sources 20. If the timbre setting instruction signal has not been generated, the timbre setting unit 99 advances to step S25. If the timbre setting instruction signal has been generated, the timbre setting unit 99 sets the timbre associated with the timbre to be set in the external sound sources 20 in the internal sound source 16 (step S24).

Next, the external sound source mixer volume setting unit 92 determines whether or not a volume setting instruction signal has been generated based on an operation of the setting operator 4 (step S25). Note that the volume setting instruction signal may also be generated based on an operation of the setting operator 4 in a setting menu relating to the volume of the electronic musical instrument. Alternatively, the volume setting instruction signal may also be set when a volume setting related message, such as a portion of a message for main volume, pan, balance, or system exclusive (SysEx) depending on the model, or the like, is detected by monitoring messages based on the MIDI standard.

If the volume setting instruction signal has not been generated, the external sound source mixer volume setting unit 92 advances to step S28. If the volume setting instruction signal has been generated, the external sound source mixer volume setting unit 92 sets the gain corresponding to the volume indicated by the volume setting instruction signal for the corresponding channel of the mixer 17*a* (step S26). Also, the external sound source volume acquisition unit 93 stores the gain set by the external sound source mixer volume setting unit 92 in the storage device 13 (step S27).

Next, the feedback acoustic signal detection unit 85 detects the state of input of the feedback acoustic signal to the feedback acoustic signal input unit 84 (step S28) and determines whether or not the state of input of the feedback acoustic signal is normal (step S29). If the state of input of the feedback acoustic signal is normal, the feedback acoustic signal detection unit 85 returns to step S21. In this case, generation of the musical tone obtained based on the external acoustic signal from the external sound source 20 is continued.

On the other hand, if the state of input of the feedback acoustic signal is not normal, the switching control unit 86 switches the sound source switching unit 82 to the connected state (step S30). Accordingly, generation of the musical tone obtained based on the internal acoustic signal from the internal sound source 16 instead of the external sound source 20 is continued. Also, the mixer volume correction unit 95 corrects the gain set for the corresponding channel of the mixer 17*a* through the processing of step S26 or the like, for example, based on the correspondence table stored in the storage device 13 (step S31).

Next, the instruction signal generation unit 81 determines whether or not an operation of the performance operator 2 has been detected (step S32). If no operation of the performance operator 2 has been detected, the instruction signal generation unit 81 waits until an operation of the performance operator 2 is detected. If an operation of the performance operator 2 has been detected, the instruction signal generation unit 81 generates the sound generation instruction signal and supplies the sound generation instruction signal to the internal sound source 16 via the sound source switching unit 82 (step S33). The internal sound source 16 generates the internal acoustic signal with the set timbre when the sound generation instruction signal is provided. The generated internal acoustic signal is supplied to the sound system 17. At this time, the volume of the musical tone obtained based on the internal acoustic signal is equal to the volume of the musical tone obtained based on the external acoustic signal.

Next, the feedback acoustic signal detection unit 85 detects the state of input of the feedback acoustic signal to the feedback acoustic signal input unit 84 (step S34) and determines whether or not the state of input of the feedback acoustic signal is normal (step S35). If the state of input of the feedback acoustic signal is not normal, the feedback acoustic signal detection unit 85 returns to step S32. In this case, generation of the musical tone obtained based on the internal acoustic signal from the internal sound source 16 is continued.

On the other hand, if the state of input of the feedback acoustic signal is normal, the switching control unit 86 switches the sound source switching unit 82 to the non-connected state (step S36). At this time, the mixer volume correction unit 95 corrects the gain set for the corresponding channel of the mixer 17*a* through the processing of step S31, based on the correspondence table stored in the storage device 13 (step S37) and advances to step S21. In this case, a new gain is calculated by dividing the gain set for the corresponding channel of the mixer 17*a* by the correction coefficient of the correspondence table, and the calculated gain is set for the corresponding channel of the mixer 17*a*. Accordingly, generation of the musical tone obtained based on the external acoustic signal from the external sound source 20 is once again continued.

In the present embodiment, the gains set in the mixer 17*a* are corrected for each channel and for each timbre. Accordingly, the gain set for each channel and for each timbre can be suitably corrected.

(6) Parameter Region (Zone) Setting

The user can cause the sound source control unit 8 to generate the sound generation instruction signal by operating the performance operator 2. The sound generation instruction signal includes parameters such as pitch and velocity. Also, the user can set multiple regions in the range of the values of the parameters included in the sound generation instruction signal. Here, the multiple set regions may overlap with each other. The channels can be respectively allocated to the multiple set regions. Accordingly, the sound generation instruction signals can be provided separately to the internal sound source 16 and the external sound sources 20. The region setting is used in a local ON state set according to a local ON command based on the MIDI standard, for example.

Figure 7:
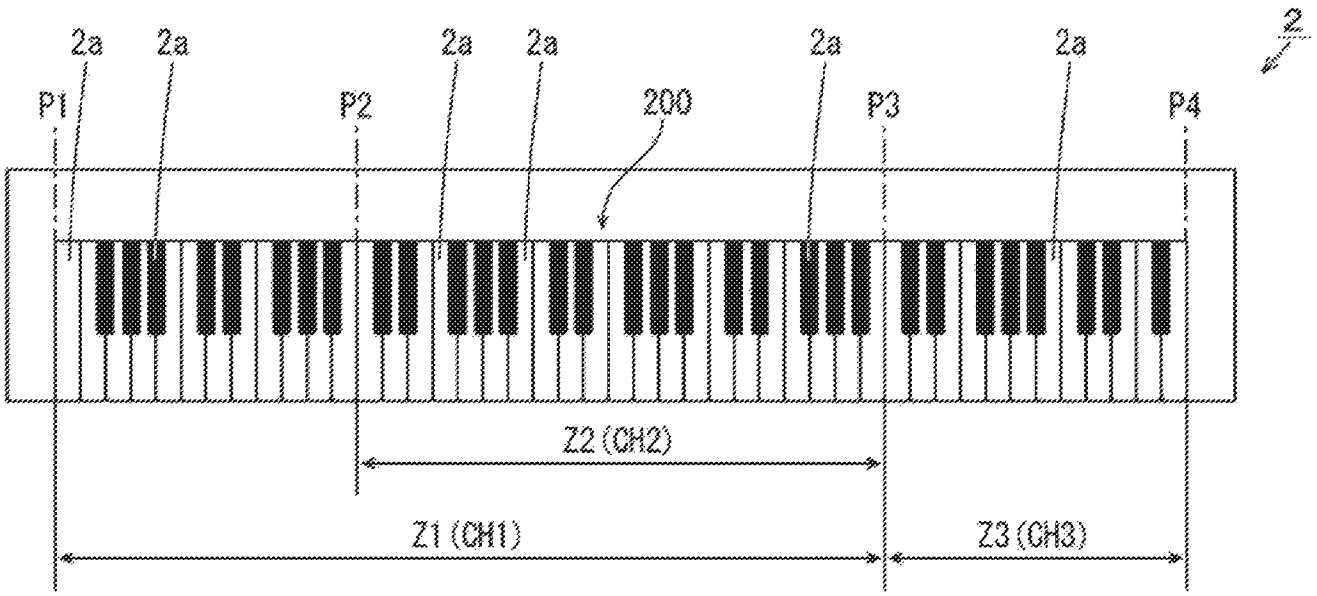
FIG. 7 is a diagram for illustrating an example of parameter region setting.

FIG. 7 is a diagram for illustrating an example of parameter region setting. As shown in FIG. 7, the performance operator 2 includes the keyboard 200. The keyboard 200 includes multiple keys 2*a* arranged in alignment in the left-right direction. The multiple keys 2*a* correspond to multiple respective pitches. The user can cause generation of a sound generation instruction signal including a corresponding pitch by pressing a desired key 2*a*.

In the example shown in FIG. 7, three regions Z1, Z2, and Z3 are set with respect to the pitch of the sound generation instruction signal. Specifically, four positions P1, P2, P3, and P4 are set in the keyboard 200 so as to be aligned in the stated order from left to right. The region Z1 is the region of the pitches corresponding to the keys 2*a* arranged between the positions P1 and P3. The region Z2 is the region of the pitches corresponding to the keys 2*a* arranged between the positions P2 and P3. The region Z3 is the region of the pitches corresponding to the keys 2*a* arranged between the positions P3 and P4.

For example, the regions Z1, Z2, and Z3 are set for the channels CH1, CH2, and CH3 respectively. In this case, when one of the keys 2*a* between the positions P1 and P2 is pressed, the sound generation instruction signal for the corresponding pitch is provided to the external sound source 20*a* of the channel CH1. When one of the keys 2*a* between the positions P2 and P3 is pressed, the sound generation instruction signal for the corresponding pitch is provided to the internal sound source 16 of the channel CH2 and the external sound source 20*a* of the channel CH1. When one of the keys 2*a* between the positions P3 and P4 is pressed, the sound generation instruction signal for the corresponding pitch is provided to the external sound source 20*b* of the channel CH3.

In the present example, for each of the channels CH1 and CH3 allocated to the regions Z1 and Z3, the sound source control processing shown in FIGS. 5 and 6 performed by the sound source control unit 8 shown in FIG. 2 is performed.

Figure 8:
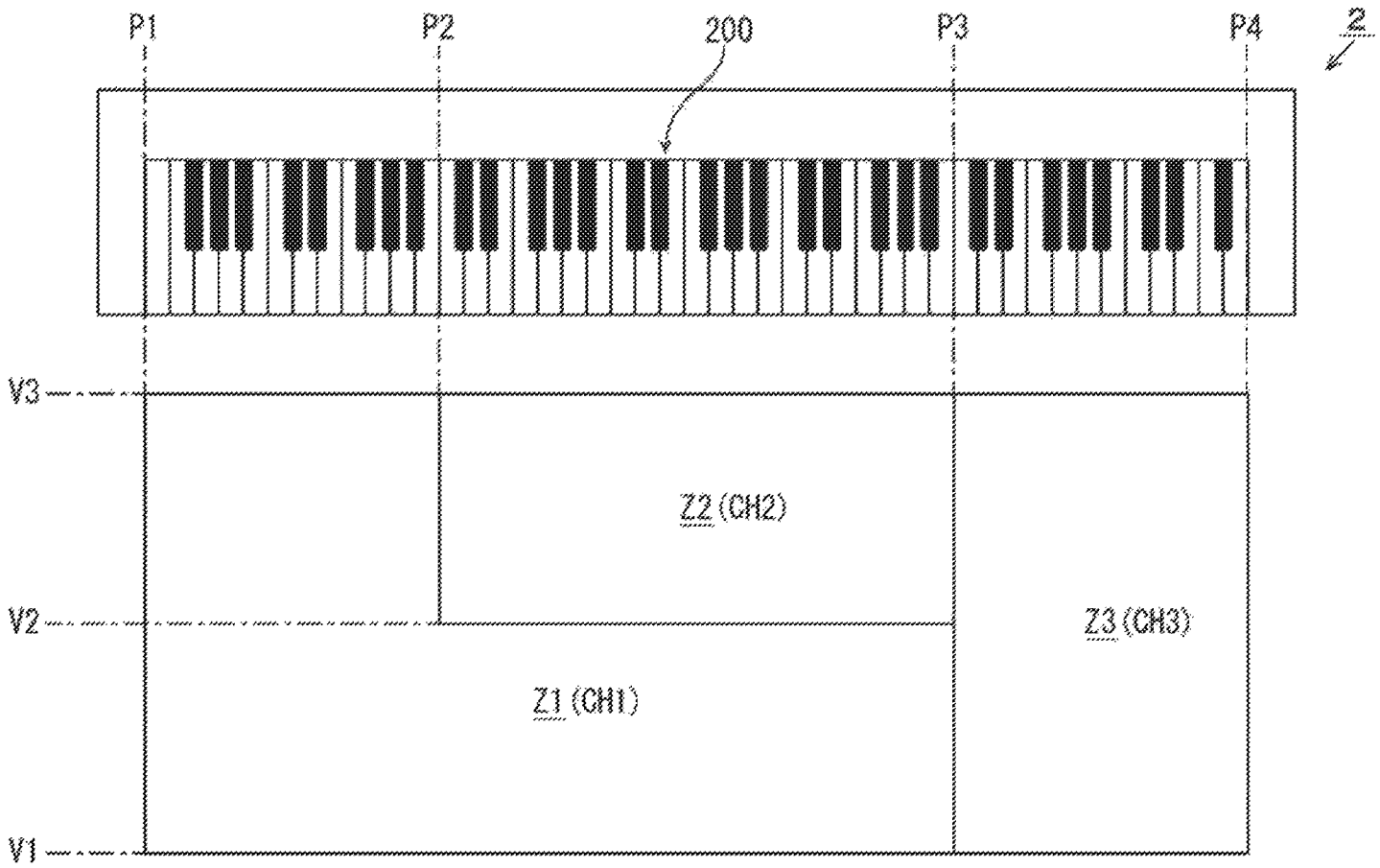
FIG. 8 is a diagram for illustrating another example of parameter region setting.

FIG. 8 is a diagram for illustrating another example of parameter region setting. In the example shown in FIG. 8, three regions Z1, Z2, and Z3 are set for combinations of the pitches and velocities of the sound generation instruction signal. Specifically, values V1, V2, and V3 of the three velocities are further set in addition to the four positions P1, P2, P3, and P4 shown in FIG. 8. The value V2 is greater than the value V1, and the value V3 is greater than the value V2.

The region Z1 includes the region of the pitches corresponding to the keys 2*a* arranged between the positions P1 and P2 and the velocities between the values V1 and V3, and the region of the pitches corresponding to the keys 2*a* arranged between the positions P2 and P3 and the velocities between the values V1 and V2. The region Z2 is the region of the pitches corresponding to the keys 2*a* arranged between the positions P2 and P3 and the velocities between the values V2 and V3. The region Z3 is the region of the pitches corresponding to the keys 2*a* arranged between the positions P3 and P4 and the velocities between the values V1 and V3.

Similarly to the example shown in FIG. 7, the regions Z1, Z2, and Z3 are allocated to the channels CH1 to CH3 respectively. In this case, if one of the keys 2*a* between the positions P1 and P2 is pressed at a velocity between the values V1 and V3, a sound generation instruction signal having the corresponding pitch and the value of the velocity is provided to the external sound source 20*a* of the channel CH1. If one of the keys 2*a* between the positions P2 and P3 is pressed at a velocity between the values V1 and V2, a sound generation instruction signal having the corresponding pitch and the value of the velocity is provided to the external sound source 20*a* of the channel CH1. If one of the keys 2*a* between the positions P2 and P3 is pressed at a velocity between the values V2 and V3, a sound generation instruction signal having the corresponding pitch and the value of the velocity is provided to the internal sound source 16 of the channel CH2. If one of the keys 2*a* between the positions P3 and P4 is pressed at a velocity between the values V1 and V3, a sound generation instruction signal having the corresponding pitch and the value of the velocity is provided to the external sound source 20*b* of the channel CH3.

In the present example as well, for each of the channels CH1 and CH3 allocated to the regions Z1 and Z3, the sound source control processing shown in FIGS. 5 and 6 performed by the sound source control unit 8 shown in FIG. 2 is performed.

(7) Effect

In the electronic musical instrument 1 according to the present embodiment, when the sound source switching unit 82 in the non-connected state, the external acoustic signal is generated by the external sound source 20 in response to the sound generation instruction signal. In this state, if a failure occurs in the external acoustic signal supplied from the external sound source 20, the sound source switching unit 82 is switched from the non-connected state to the connected state. Accordingly, the internal acoustic signal is generated by the internal sound source 16 in response to the sound generation instruction signal. At this time, the gain set in the mixer 17*a* is corrected such that the volume of the musical tone generated based on the internal acoustic signal and the volume of the musical tone generated based on the external acoustic signal are equal. Accordingly, even if a failure occurs in the external acoustic signal, sound generation can be continued while suppressing a sense of incongruity felt by the user.

Second Embodiment

Aspects of the electronic musical instrument system according to the second embodiment that differ from the electronic musical instrument system 100 according to the first embodiment will be described.

(1) Configuration of Electronic Musical Instrument System

Figure 9:
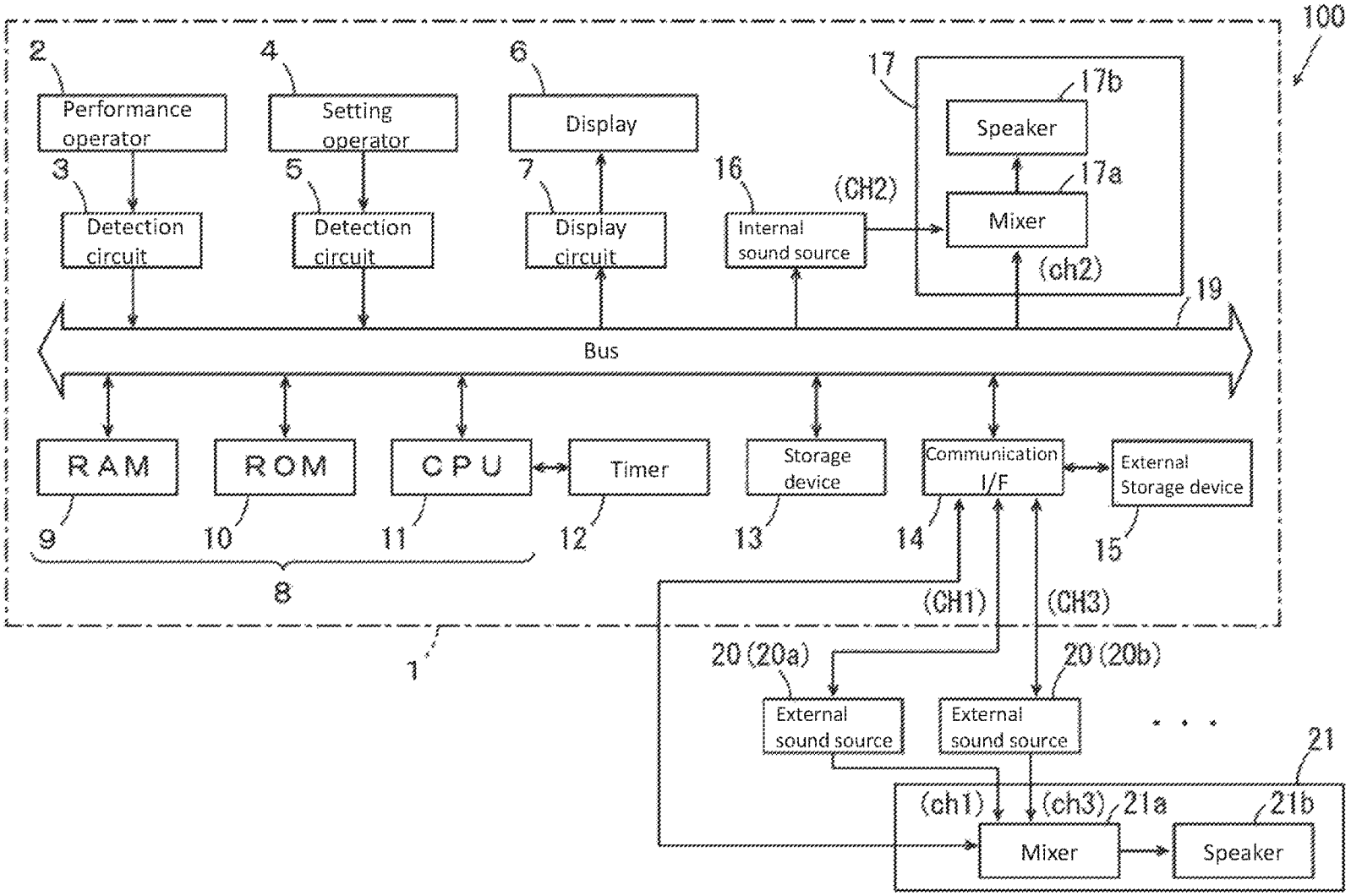
FIG. 9 is a block diagram showing a configuration of an electronic musical instrument system according to a second embodiment.

FIG. 9 is a block diagram showing a configuration of an electronic musical instrument system according to a second embodiment. The configuration of the sound source control unit 8 according to the present embodiment is similar to the configuration shown in FIG. 2. The electronic musical instrument system 100 shown in FIG. 9 further includes an additional sound system 21 in addition to the configuration of the electronic musical instrument 100 shown in FIG. 1. The sound system 21 essentially has the same configuration as the sound system 17, and is provided outside of the electronic musical instrument 1 along with one or more external sound source 20.

In the present embodiment, the sound system 17 built into the electronic musical instrument 1 generates a musical tone obtained based on the internal acoustic signal generated by the internal sound source 16, and the sound system 21 provided outside of the electronic musical instrument 1 generates musical tones obtained based on the external acoustic signals generated by the one or more external sound sources 20.

Similarly to the mixer 17*a* of the sound system 17, a mixer 21*a* of the sound system 21 has channels ch1, ch2, and ch3. In the present embodiment, the internal acoustic signal of the internal sound source 16 to which the channel CH2 is allocated is input to the channel ch2 of the mixer 17*a*. The external acoustic signal of the external sound source 20*a* to which the channel CH1 is allocated is input to the channel ch1 of the mixer 21*a*, and the external acoustic signal of the external sound source 20*b* to which the channel CH3 is allocated is input to the channel ch3 of the mixer 21*a*. Accordingly, the musical tone obtained based on the internal acoustic signal of the internal sound source 16 is generated by the speaker 17*b* of the sound system 17 and the musical tone obtained based on the external acoustic signals of the external sound sources 20*a* and 20*b* are generated by the speaker 21*b*. The gains of the unused channels ch1 and ch3 of the mixer 17*a* and the gain of the unused channel ch2 of the mixer 21*a* are 0.

When a failure of the external acoustic signal occurs, the sound source control unit 8 according to the present embodiment switches the external acoustic signals to the internal acoustic signal of the internal sound source 16 for the channels CH1 and CH3 allocated to the external sound sources 20*a* and 20*b*. In this case, the internal acoustic signal generated instead of the external acoustic signals in the internal sound source 16 is input to the channels ch1 and ch3 of the mixer 17*a* of the sound system 17. At this time, when the gains of the channels ch1 and ch3 of the mixer 17*a* are set to 0, the volume of the musical tone obtained based on the external acoustic signal becomes 0. In view of this, the sound source control unit 8 corrects the gains of the channels ch1 and ch3 of the mixer 17*a* such that they are equal to the gains of the channels ch1 and ch3 of the mixer 21*a*. Accordingly, the volume of the musical tone generated based on the internal acoustic signal approaches the volume of the musical tone generated based on the external acoustic signals. Accordingly, sound generation can be continued while suppressing a sense of incongruity felt by the user.

(2) Example of Correction of Gains Set in Mixer

Figure 10B:
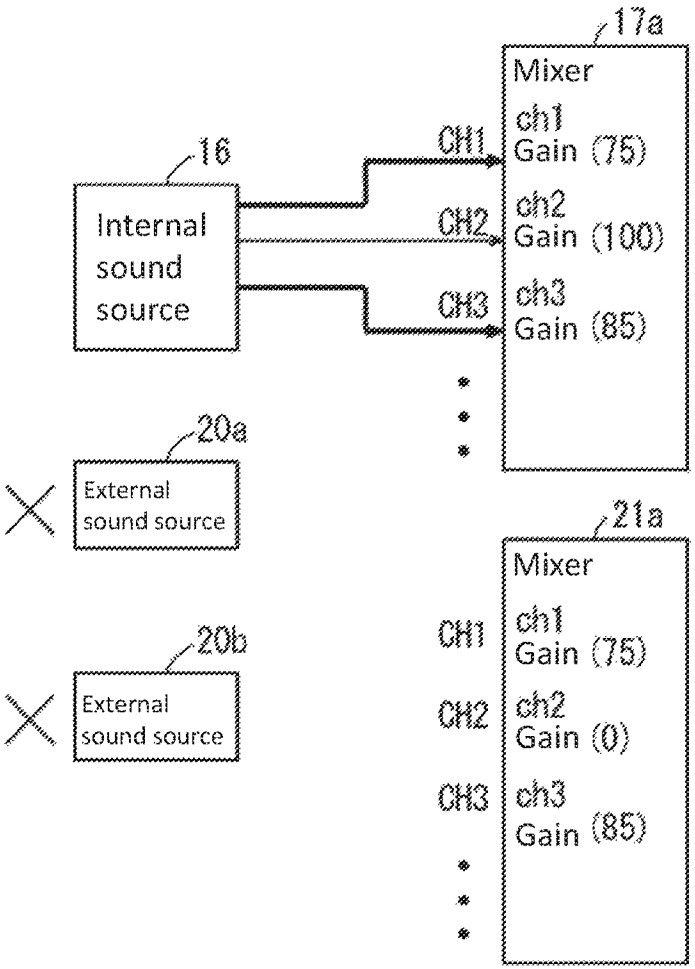
FIGS. 10A and 10B are schematic diagrams showing an example of correction of gain of a mixer performed when a sound source switching unit is switched from a non-connected state to a connected state in a sound source control unit shown in FIG. 9.
Figure 10A:
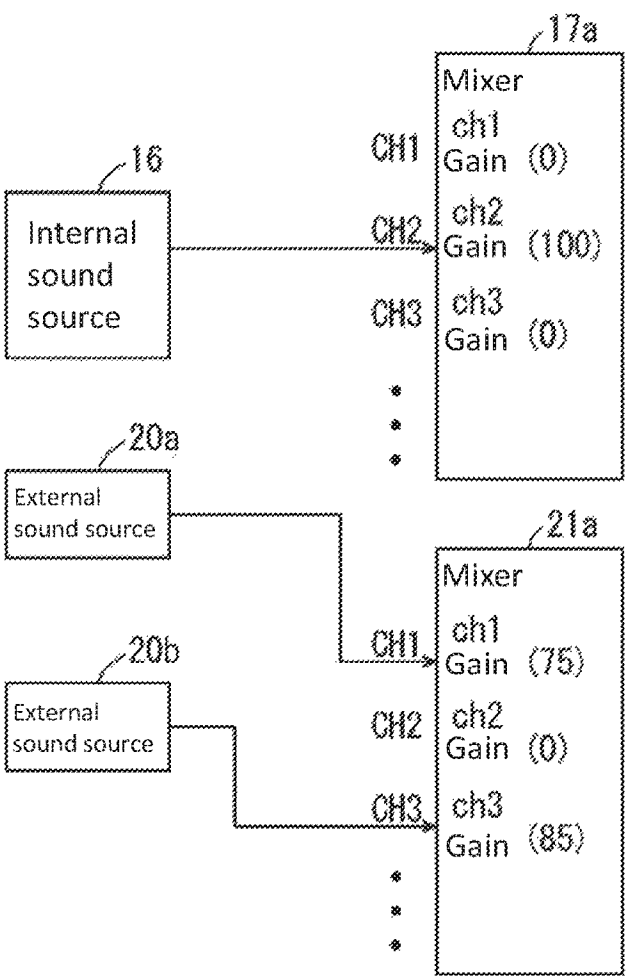

FIGS. 10A and 10B are schematic diagrams showing an example of correction of gains of the mixer 17*a* at a time when the sound source switching unit 82 (FIG. 2) is switched from the non-connected state to the connected state in the sound source control unit 8 shown in FIG. 9. FIG. 10A shows an example of gains set in the mixers 17*a* and 21*a* when the sound source switching unit 82 shown in FIG. 2 is in the non-connected state. FIG. 10B shows an example of gains set in the mixers 17*a* and 21*a* when the sound source switching unit 82 shown in FIG. 2 is in the connected state.

As shown in FIG. 10A, when the sound source switching unit 82 is in the non-connected state, the gains 75, 100, and 85 are respectively set for the channel ch1 of the mixer 21*a*, the channel ch2 of the mixer 17*a*, and the channel ch3 of the mixer 21*a*, which correspond to the channels CH1, CH2, and CH3. The gain 0 is set for the channels ch1 and ch3 of the mixer 17*a* and the channel ch2 of the mixer 21*a*, to which the acoustic signal is not input.

In this state, if a failure occurs in the external acoustic signals generated from the external sound sources 20*a* and 20*b*, the sound source switching unit 82 is switched from the non-connected state to the connected state. In this case, as indicated by the thick solid line in FIG. 10B, the internal acoustic signals of the channels CH1 and CH3 generated by the internal sound source 16 are input to the channels ch1 and ch3 of the mixer 17*a*.

At this time, the mixer volume correction unit 95 shown in FIG. 2 sets the gains 75 and 85 set respectively for the channels ch1 and ch3 of the mixer 21*a* as the gains of the channels ch1 and ch3 of the mixer 17*a*. In this manner, the gains of the channels ch1 and ch3 of the mixer 17*a* are corrected based on the gains of the channels ch1 and ch3 of the mixer 21*a*. Accordingly, it is possible to continue sound generation while suppressing a sense of incongruity felt by the user when the sound source switching unit 82 is switched from the non-connected state to the connected state.

(3) Effect

Similarly to the electronic musical instrument 1 according to the first embodiment, in the electronic musical instrument 1 according to the present embodiment as well, if a failure occurs in the external acoustic signal supplied from the external sound source 20, the sound source switching unit 82 is switched from the non-connected state to the connected state. Accordingly, the internal acoustic signal is generated by the internal sound source 16 in response to the sound generation instruction signal. At this time, the gain of the mixer 17*a* is corrected based on the gain of the mixer 21*a* such that the volume of the musical tone generated based on the internal acoustic signal approaches the volume of the musical tone generated based on the external acoustic signal. Accordingly, even if a failure occurs in the external acoustic signal, sound generation can be continued while suppressing a sense of incongruity felt by the user.

Other Embodiments (a) In the above-described embodiment, the volume of the internal acoustic signal is adjusted by the mixer 17*a*, but the volume of the acoustic signal may also be adjusted by another constituent element such as the internal sound source 16. In this case as well, when the external acoustic signal is switched to the internal acoustic signal, the volume of the internal acoustic signal is adjusted such that the volume of the musical tone generated based on the internal acoustic signal approaches or becomes equal to the volume of the musical tone generated based on the external acoustic signal.

(b) In the above-described embodiment, the parameter relating to the volume is the volume, but the parameter relating to the volume may also be the pan position. In this case, when the external acoustic signal is switched to the internal acoustic signal, the volume of the internal acoustic signal is adjusted such that the pan position of the musical tone generated based on the internal acoustic signal approaches or becomes equal to the pan position of the musical tone generated based on the external acoustic signal.

(c) In order to adjust the gains of the mixers 17*a* and 21*a*, a message based on the MIDI standard may be used, or another control signal may be used. Also, the electronic musical instrument 1 and the external sound source 20 may be connected through a USB (Universal Serial Bus) or Bluetooth (registered trademark), or communication based on another standard such as OSC (Open Sound Control) may be used.

(d) Switching of the supply of the sound generation instruction signal to the internal sound source 16 or the external sound sources 20, and switching of the non-connected state and the connected state of the sound source switching unit 82 may also be performed through a local ON command and the local OFF command based on the MIDI standard, or the switching may also be performed through independent mode switching.

(e) In the above-described embodiment, the sound source control unit 8 shown in FIGS. 2 and 10 is realized through hardware such as the CPU 11 and software such as the sound source control program, but the constituent elements of the sound source control unit 8 may also be realized through hardware such as an electronic circuit.

(f) In the above-described embodiment, the sound systems 17 and 21 respectively include the speakers 17*b* and 21*b* as the sound generation means, but the sound systems 17 and 21 may also include headphones or earphones instead of the speakers 17*b* and 21*b* as the sound generation means.

(g) An effect obtained based on an auditory psychological model may also be applied in the adjustment of the volume obtained by the mixer volume correction unit 95. According to the auditory psychological model, a sound in a lower tone range sounds quieter to a person's ear than a sound in a higher tone range. In view of this, the mixer volume correction unit 95 may also adjust the gain according to the pitch of the internal acoustic signal or the external acoustic signal. For example, the gain can be adjusted such that the volume increases the lower the pitch of the sound is and the volume decreases the higher the pitch of the sound is.

Correspondence Between Constituent Elements of Claims and Units of Embodiments

Hereinafter, an example of a correspondence between constituent elements of the claims and the units of the embodiments will be described, but the present invention is not limited to the example. Other various elements having the configurations or functions described in the claims can be used as the constituent elements of the claims.

In the above-described embodiments, the instruction signal generation unit 81 is an example of a generation means, the instruction signal output unit 83 is an example of an output means, the sound source switching unit 82 is an example of a switching means, the internal sound source mixer volume setting unit 91 is an example of a first setting means, the external sound source mixer volume setting unit 92 is an example of a second setting means, the external sound source volume acquisition unit 93 is an example of a first acquisition means, the mixer volume correction unit 95 is an example of a volume control means or a correction means, the correction coefficients in the correspondence table are examples of correspondence relationships, and the correspondence table acquisition unit 94 is an example of the second acquisition means.

Also, the multiple channels CH1, CH2, and CH3 of the electronic musical instrument 1 are examples of multiple channels, the mixer 17*a* is an example of a first mixer, the mixer 21*a* is an example of a second mixer, the region setting unit 97 is an example of a third setting means, the feedback acoustic signal input unit 84 is an example of an input means, the feedback acoustic signal detection unit 85 is an example of a detection means, the external sound sources 20, 20*a*, and 20*b* are examples of one or multiple external sound sources, and the speakers 17*b* and 21*b* are examples of sound generation means. Other various elements having the configurations or functions described in the claims can be used as the constituent elements of the claims.

LIST OF REFERENCE NUMERALS

1 Electronic musical instrument
2 Performance operator
2*a* Key
3, 5 Detection circuit
4 Setting operator
6 Display
7 Display circuit
8 Sound source control unit
9 RAM
10 ROM
11 CPU
12 Timer
13 Storage device
14 Communication OF
15 External storage device
16 Internal sound source
17, 21 Sound system
17*a*, 21*a* Mixer
17*b*, 21*b* Speaker
19 Bus
20, 20*a*, 20*b* External sound source
81 Instruction signal generation unit
82 Sound source switching unit
83 Instruction signal output unit
84 Feedback acoustic signal input unit
85 Feedback acoustic signal detection unit
86 Switching control unit
91 Internal sound source mixer volume setting unit
92 External sound source mixer volume setting unit
93 External sound source volume acquisition unit
94 Correspondence table acquisition unit
95 Mixer volume correction unit
97 Region setting unit
99 Timbre setting unit
100 Electronic musical instrument system
200 Keyboard
CH1, CH2, CH3, ch1, ch2, ch3 Channel
P1, P2, P3, P4 Position
V1, V2, V3 Value
Z1, Z2, Z3 Region

The invention claimed is:

1. An electronic musical instrument, comprising:

an internal sound source configured to generate an internal acoustic signal;

a generation means configured to generate a sound generation instruction signal;

an output means connected to an external sound source configured to generate an external acoustic signal, and configured to output the sound generation instruction signal to the external sound source;

a switching means configured to switch a first state in which the external acoustic signal is generated by the external sound source in response to the sound generation instruction signal to a second state in which the internal acoustic signal is generated by the internal sound source in response to the sound generation instruction signal;

a volume control means configured to, when the first state is switched to the second state, control a volume of the internal acoustic signal such that a state relating to a volume of sound generation based on the internal acoustic signal approaches a state relating to a volume of sound generation based on the external acoustic signal;

a first setting means configured to set a first value as a value of a parameter relating to the volume of the internal acoustic signal;

a second setting means configured to set a second value as a value of a parameter relating to the volume of the external acoustic signal; and a first acquisition means configured to acquire the second value set by the second setting means, wherein when the first state is switched to the second state, the volume control means is configured to control the first value based on the acquired second value such that the state relating to the volume of sound generation based on the internal acoustic signal approaches the state relating to the volume of sound generation based on the external acoustic signal, and the volume control means includes a correction means configured to, when the first state is switched to the second state, correct the set first value based on the acquired second value such that the state relating to the volume of sound generation based on the internal acoustic signal approaches the state relating to the volume of sound generation based on the external acoustic signal.

2. The electronic musical instrument according to claim 1, further comprising:

a second acquisition means configured to acquire a correspondence relationship between the first value and the second value in a case where the state relating to the volume is equal for sound generation based on the internal acoustic signal and sound generation based on the external acoustic signal, wherein when the first state is switched to the second state, the volume control means is configured to control the first value based on the acquired correspondence relationship and the acquired second value.

3. The electronic musical instrument according to claim 2, wherein the correspondence relationship is determined for each timbre, and when the first state is switched to the second state, the volume control means is configured to adjust the first value based on a correspondence relationship corresponding to a timbre of the external acoustic signal among the acquired correspondence relationships, and based on the acquired second value.

4. The electronic musical instrument according to claim 2, wherein the electronic musical instrument includes a plurality of channels, the first setting means is configured to set the first value for each of the plurality of channels, the second setting means is configured to set the second value for each of the plurality of channels, and when the first state is switched to the second state for one or more target channels among the plurality of channels, the volume control means is configured to control the first value corresponding to the target channel based on the acquired correspondence relationship and the acquired second value corresponding to the target channel.

5. The electronic musical instrument according to claim 1, wherein the first value indicates the volume or pan position of the internal acoustic signal, and the second value indicates the volume or pan position of the external acoustic signal.

6. The electronic musical instrument according to claim 1, further comprising:

a third setting means configured to set a plurality of regions determined based on a third value included in the sound generation instruction signal, wherein the external sound source is allocated to a first region among the set plurality of regions, the first setting means is configured to set the first value of the internal acoustic signal for the first region, the second setting means is configured to set the second value of the external acoustic signal for the first region, the first acquisition means is configured to acquire the second value set for the first region, and when the first state is switched to the second state for the first region, the volume control means is configured to control the first value for the first region based on the second value acquired for the first region.

7. The electronic musical instrument according to claim 1, further comprising:

an input means configured to receive the external acoustic signal generated by the external sound source as a feedback acoustic signal; and a detection means configured to detect a state of input of the feedback acoustic signal to the input means, wherein the switching means is configured to switch the first state to the second state in response to a transition from a state in which input of the feedback acoustic signal to the input means is normal, to a state in which input of the feedback acoustic signal to the input means is not normal.

8. The electronic musical instrument according to claim 7, wherein the switching means is configured to switch the second state to the first state in response to a transition from a state in which input of the feedback acoustic signal to the input means is not normal, to a state in which input of the feedback acoustic signal to the input means is normal.

9. An electronic musical instrument system, comprising:

the electronic musical instrument according to claim 1;

one or more external sound sources connected to the electronic musical instrument; and a sound generation means configured to generate a sound based on the internal acoustic signal generated by the internal sound source of the electronic musical instrument and the external acoustic signal generated by the one or more external sound sources.

10. An electronic musical instrument, comprising:

an internal sound source configured to generate an internal acoustic signal;

a generation means configured to generate a sound generation instruction signal;

an output means connected to an external sound source configured to generate an external acoustic signal, and configured to output the sound generation instruction signal to the external sound source;

a switching means configured to switch a first state in which the external acoustic signal is generated by the external sound source in response to the sound generation instruction signal to a second state in which the internal acoustic signal is generated by the internal sound source in response to the sound generation instruction signal;

a volume control means configured to, when the first state is switched to the second state, control a volume of the internal acoustic signal such that a state relating to a volume of sound generation based on the internal acoustic signal approaches a state relating to a volume of sound generation based on the external acoustic signal;

a first setting means configured to set a first value as a value of a parameter relating to the volume of the internal acoustic signal;

a second setting means configured to set a second value as a value of a parameter relating to the volume of the external acoustic signal; and a first acquisition means configured to acquire the second value set by the second setting means, wherein when the first state is switched to the second state, the volume control means is configured to control the first value based on the acquired second value such that the state relating to the volume of sound generation based on the internal acoustic signal approaches the state relating to the volume of sound generation based on the external acoustic signal, the electronic musical instrument includes a plurality of channels, the first setting means is configured to set the first value for each of the plurality of channels, the second setting means is configured to set the second value for each of the plurality of channels, and when the first state is switched to the second state for one or more target channels among the plurality of channels, the volume control means is configured to control the first value corresponding to the target channel based on the acquired correspondence relationship and the acquired second value corresponding to the target channel.

11. The electronic musical instrument according to claim 10, further comprising:

a mixer configured to mix the internal acoustic signal corresponding to a first channel among the plurality of channels and the external acoustic signal corresponding to a second channel among the plurality of channels, wherein in the first state, the external acoustic signal corresponding to the second channel is generated by the external sound source in response to the sound generation instruction signal corresponding to the second channel, in the second state, the internal acoustic signal corresponding to the second channel is generated by the internal sound source in response to the sound generation instruction signal corresponding to the second channel, the first setting means is configured to set the first value of the internal acoustic signal corresponding to the second channel, the second setting means is configured to set the second value of the external acoustic signal corresponding to the second channel, the first acquisition means is configured to acquire the second value corresponding to the second channel set by the second setting means, and when the first state is switched to the second state for the second channel, the volume control means is configured to control the first value corresponding to the second channel based on the acquired second value corresponding to the second channel.

12. The electronic musical instrument according to claim 10, further comprising:

a first mixer configured to mix the internal acoustic signals corresponding to two or more channels among the plurality of channels, wherein the electronic musical instrument is connectable to a second mixer configured to mix the external acoustic signals corresponding to two or more channels among the plurality of channels, in the first state, the external acoustic signal corresponding to a first channel is generated by the external sound source in response to the sound generation instruction signal corresponding to the first channel among the plurality of channels, in the second state, the internal acoustic signal corresponding to the first channel is generated by the internal sound source in response to the sound generation instruction signal corresponding to the first channel, the first setting means is configured to set the first value of the internal acoustic signal corresponding to the first channel, the second setting means is configured to set the second value of the external acoustic signal corresponding to the first channel, the first acquisition means is configured to acquire the second value corresponding to the first channel set by the second setting means, and when the first state is switched to the second state for the first channel, the volume control means is configured to control the first value corresponding to the first channel based on the acquired second value corresponding to the first channel.

13. An electronic musical instrument system, comprising:

the electronic musical instrument according to claim 10;

one or more external sound sources connected to the electronic musical instrument; and a sound generation means configured to generate a sound based on the internal acoustic signal generated by the internal sound source of the electronic musical instrument and the external acoustic signal generated by the one or more external sound sources.

14. The electronic musical instrument according to claim 10, further comprising:

a second acquisition means configured to acquire a correspondence relationship between the first value and the second value in a case where the state relating to the volume is equal for sound generation based on the internal acoustic signal and sound generation based on the external acoustic signal, wherein when the first state is switched to the second state, the volume control means is configured to control the first value based on the acquired correspondence relationship and the acquired second value.

15. The electronic musical instrument according to claim 10, wherein the first value indicates the volume or pan position of the internal acoustic signal, and the second value indicates the volume or pan position of the external acoustic signal.

16. The electronic musical instrument according to claim 10, further comprising:

a third setting means configured to set a plurality of regions determined based on a third value included in the sound generation instruction signal, wherein the external sound source is allocated to a first region among the set plurality of regions, the first setting means is configured to set the first value of the internal acoustic signal for the first region, the second setting means is configured to set the second value of the external acoustic signal for the first region, the first acquisition means is configured to acquire the second value set for the first region, and when the first state is switched to the second state for the first region, the volume control means is configured to control the first value for the first region based on the second value acquired for the first region.

17. The electronic musical instrument according to claim 10, further comprising:

an input means configured to receive the external acoustic signal generated by the external sound source as a feedback acoustic signal; and a detection means configured to detect a state of input of the feedback acoustic signal to the input means, wherein the switching means is configured to switch the first state to the second state in response to a transition from a state in which input of the feedback acoustic signal to the input means is normal, to a state in which input of the feedback acoustic signal to the input means is not normal.

18. A method comprising:

generating a sound generation instruction signal in an electronic musical instrument including an internal sound source configured to generate an internal acoustic signal;

outputting the sound generation instruction signal from the electronic musical instrument to an external sound source configured to generate an external acoustic signal;

switching a first state in which the external acoustic signal is generated by the external sound source in response to the sound generation instruction signal to a second state in which the internal acoustic signal is generated by the internal sound source in response to the sound generation instruction signal;

automatically controlling a volume of the internal acoustic signal such that a state relating to a volume of sound generation based on the internal acoustic signal approaches a state relating to a volume of sound generation based on the external acoustic signal, when the first state is switched to the second state, setting a first value as a value of a parameter relating to the volume of the internal acoustic signal;

setting a second value as a value of a parameter relating to the volume of the external acoustic signal;

acquiring the second value, and when the first state is switched to the second state, controlling the first value based on the acquired second value such that the state relating to the volume of sound generation based on the internal acoustic signal approaches the state relating to the volume of sound generation based on the external acoustic signal, wherein when the first state is switched to the second state, the controlling of the first value includes correcting the set first value based on the acquired second value such that the state relating to the volume of sound generation based on the internal acoustic signal approaches the state relating to the volume of sound generation based on the external acoustic signal.

19. A method comprising:

generating a sound generation instruction signal in an electronic musical instrument including an internal sound source configured to generate an internal acoustic signal;

outputting the sound generation instruction signal from the electronic musical instrument to an external sound source configured to generate an external acoustic signal;

switching a first state in which the external acoustic signal is generated by the external sound source in response to the sound generation instruction signal to a second state in which the internal acoustic signal is generated by the internal sound source in response to the sound generation instruction signal;

automatically controlling a volume of the internal acoustic signal such that a state relating to a volume of sound generation based on the internal acoustic signal approaches a state relating to a volume of sound generation based on the external acoustic signal, when the first state is switched to the second state;

the electronic musical instrument includes a plurality of channels;

setting the first value for each of the plurality of channels;

setting the second value for each of the plurality of channels; and when the first state is switched to the second state for one or more target channels among the plurality of channels, controlling the first value corresponding to the target channel based on the acquired correspondence relationship and the acquired second value corresponding to the target channel.

* * * * *